US006361164B1

(12) United States Patent
Sansone

(10) Patent No.: US 6,361,164 B1
(45) Date of Patent: Mar. 26, 2002

(54) SYSTEM THAT METERS THE FIRINGS OF A PRINTER TO AUDIT THE DOTS OR DROPS OR PULSES PRODUCED BY A DIGITAL PRINTER

(75) Inventor: Ronald P. Sansone, Weston, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/458,231

(22) Filed: Dec. 9, 1999

(51) Int. Cl.[7] ..... B41J 2/01
(52) U.S. Cl. ..... 347/107; 705/401
(58) Field of Search ..... 347/2, 107, 11, 347/40, 44; 705/401, 410; 101/91

(56) References Cited

U.S. PATENT DOCUMENTS

| | | | | |
|---|---|---|---|---|
| 4,121,222 A | | 10/1978 | Diebold et al. | 347/7 |
| 4,319,328 A | * | 3/1982 | Eggert | 364/466 |
| 4,413,264 A | | 11/1983 | Cruz-Uribe et al. | 347/6 |
| 4,455,562 A | | 6/1984 | Dolan et al. | 347/130 |
| 4,813,912 A | * | 3/1989 | Chickneas et al. | 364/464.02 |
| 4,872,027 A | | 10/1989 | Buskirk et al. | 347/19 |
| 5,049,898 A | | 9/1991 | Arthur et al. | 347/17 |
| 5,068,806 A | | 11/1991 | Gatten | 395/113 |
| 5,122,967 A | * | 6/1992 | Gilham | 364/479 |
| 5,414,452 A | | 5/1995 | Accatino et al. | 347/7 |
| 5,513,563 A | | 5/1996 | Berson | 101/91 |
| 5,694,156 A | | 12/1997 | Hoisington et al. | 347/7 |
| 5,793,388 A | | 8/1998 | Martinson et al. | 347/19 |

* cited by examiner

*Primary Examiner*—N. Le
*Assistant Examiner*—Shih-wen Hsieh
(74) *Attorney, Agent, or Firm*—Ronald Reichman; Angelo N. Chaclas

(57) ABSTRACT

A device for verifying security in a postage meter or other devices using dot or drop printing. Security is achieved by counting the number of signal pulse firings that are used to produce ink drops or ink dots that are required to produce the entire document or specific regions of the document. The aforementioned may be accomplished by storing the printer firings in a two dimensional non-volatile memory array and auditing the printed material on the mail piece by using the firings of the printer to compare the value that is printed on the mail piece to the value decremented in the registers of the meter. The apparatus of the invention determines what is printed on the mail piece by reading the printer firings (that represent the alphanumeric characters or other data produced) and comparing it with the value stored in non-volatile memory.

14 Claims, 13 Drawing Sheets

"PCR" OUTPUT VALUES =

A' = 0
B' = 0
C' = ·
D' = 1
E' = 1
F' = 1

SYSTEM THAT METERS THE FIRINGS OF A PRINTER TO AUDIT THE DOTS OR DROPS OR PULSES PRODUCED BY A DIGITAL PRINTER

CROSS REFERENCE TO RELATED APPLICATIONS

Reference is made to commonly assigned copending patent application Ser. No. 09/458,151 filed herewith entitled "A System for Metering and Auditing the Dots or Drops or Pulses Produced by a Digital Printer" in the name of Ronald P. Sansone, U.S. Pat. No. 6,318,856 and Ser. No. 09/458,237 filed herewith entitled "A System for Metering and Auditing the Dots or Drops or Pulses Produced by a Digital Printer in Printing an Arbitrary Graphic" in the names of Ronald P. Sansone and Judith A. Martin now still pending.

FIELD OF THE INVENTION

This invention pertains to digital printing and more particularly to the metering and auditing of the dots or drops produced by a digital printer.

DESCRIPTION OF THE PRIOR ART

Printers that print characters in the form of dots have been utilized in postage meters and other devices. The aforementioned printers form characters and/or graphics from a matrix of dots. Unlike the fully formed character printing methods, the printing elements are organized in rows or columns which print dots. A character in a dot printer is formed sequentially by printing at one time all the selected dots, respectively, in a column or a row. Graphics are made possible by precisely positioning dots on a page.

Printers that print characters and graphics by depositing drops of ink on a medium have been utilized in postage meters and other devices. The aforementioned printers form characters and graphics by selectively firing droplets of ink onto a surface. The ink dries upon its absorption into the substance.

Laser printers print characters and graphics by utilizing a focused laser beam and a rotating mirror to draw an image of the desired page on a photosensitive drum. The laser is pulsed periodically or fired periodically to produce small discharged areas on the photosensitive drum that represent the image. The charged image attracts and holds toner. A piece of paper is rolled against the drum while a charged plate behind the paper attracts the toner away from the drum and onto the paper. Heat and/or pressure is then applied to fuse the toner to the paper.

Dot matrix printers print characters. A dot matrix printer may have a 9 or 24 pin head. The pins impact the paper through a ribbon, creating patterns of dots in the shape of letters and numbers in multiple fonts and type sizes.

Thermal matrix printers have an array of 100 to 200 pins which are placed in contact with thermally sensitive paper. The pins are pulsed or fired with electrical current heating the pins. The heat produced darkens selective areas of the moving paper.

Printers that print by using dots and drops are commercially available as desk top printers and are often utilized as output devices of personal computers. The wide use of the above printers has made it easier to forge documents. Thus, additional security is needed to determine the authenticity of the printed document. One method that has been proposed for providing security is to print encrypted information in the document and decrypting the information at a later time to authenticate the document. One of the disadvantages of the foregoing is that it may be necessary to use a large amount of space on the document to prevent the encrypted information from being decrypted.

Another method that has been proposed for providing security to documents is to print authenticating text in invisible ink on the document as a means of authenticating the document. A luminescent ink may also be used for similar security purposes. One of the disadvantages of the foregoing is that it may be necessary to use special chemicals or an ultraviolet light source to read the authenticating text.

Another method utilized by the prior art for providing security to documents involved the hiding of some information in the document or the modification of some information in the document. The hidden or modified information may be placed in graphics contained in the document. The hidden or modified information was accurately placed so as not to disturb the information. One of the disadvantages of the above is that it is difficult to read the hidden or modified information.

SUMMARY OF THE INVENTION

This invention overcomes the disadvantages of the prior art by providing a system that makes it more difficult to print fraudulent documents. The apparatus of this invention provides a device for verifiable security in a postage meter or other devices i.e., tax meter, stock certificate printer, bank note printer, certified check printer, etc. using dot or drop printing. Security is achieved by counting the number of signal pulse firings that are used to produce ink drops or ink dots that are required to produce the entire document or specific regions of the document. The aforementioned may be accomplished by storing the printer firings in a two dimensional, non-volatile memory array and auditing the printed material on the mail piece by using the firings of the printer to compare the value that is printed on the mail piece to the value decremented in the registers of the meter. The apparatus of the invention determines what is printed on the mail piece by reading the printer firings (that represent the alphanumeric characters or other data produced) and comparing it with the value stored in non-volatile memory.

An advantage of this invention is that it can accurately determine the amount of postage that is printed without encountering errors due to paper, velocity of the paper, ink, paper skew, etc.

DETAILED DESCRIPTION OF THE PREFERRED EMBODIMENT

Figure 1:
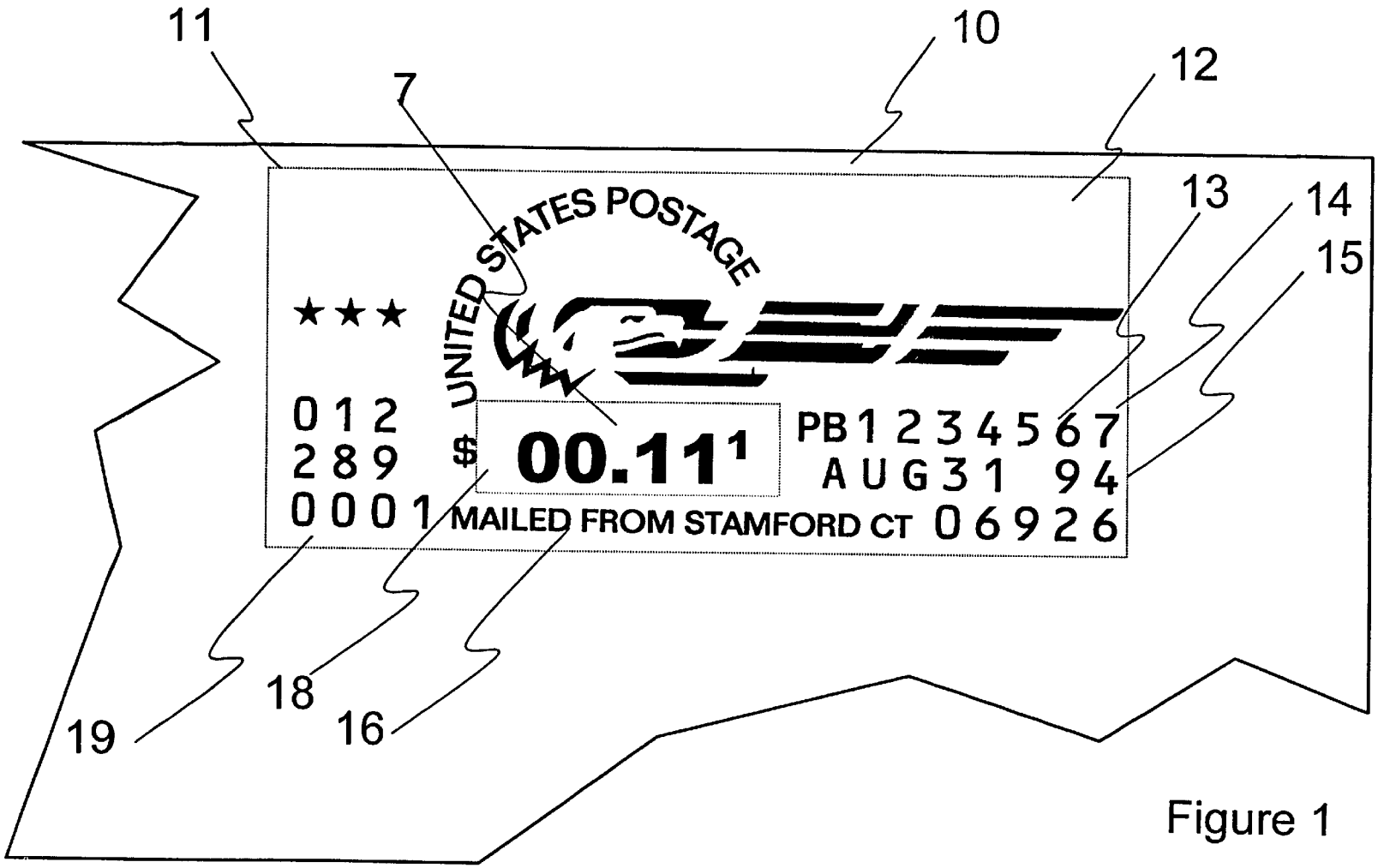
FIG. 1 is a drawing of a postal indicia affixed to a mail piece.

Referring now to the drawings in detail, and more particularly to FIG. 1, the reference character 10 represents a mail piece that has a postal indicia 11 affixed thereto. Indicia 11 has a graphics region 12 and a fixed and variable text region 13.

Region 13 contains a postal meter serial number 14, the date 15, the place the mail piece was mailed from 16, a dollar amount of postage 18, and a security code 19. Indicia 11 may be printed with an ink jet printer, laser printer or thermal printer (not shown). Region 13 includes a region 7 that has a dollar amount of postage contained therein. Indicia 11 may be produced by an electronic postage meter.

Figure 2B:
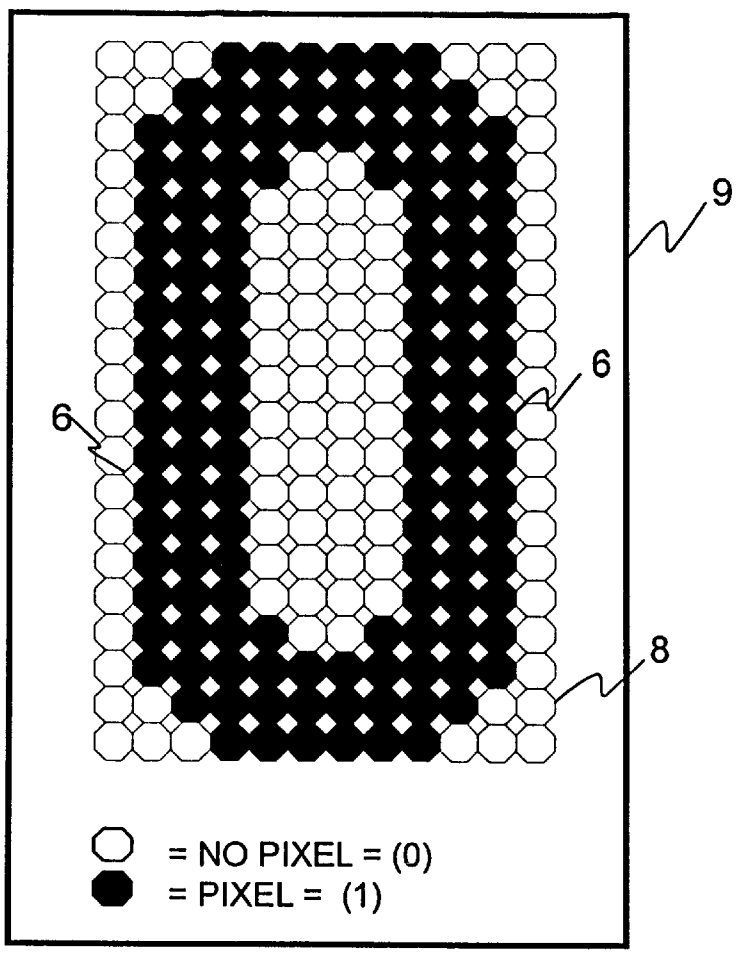
FIG. 2B is a drawing showing the manner in which the print head pulses that printed the numeric character of FIG. 2A are stored in a portion of non-volatile memory.
Figure 2A:
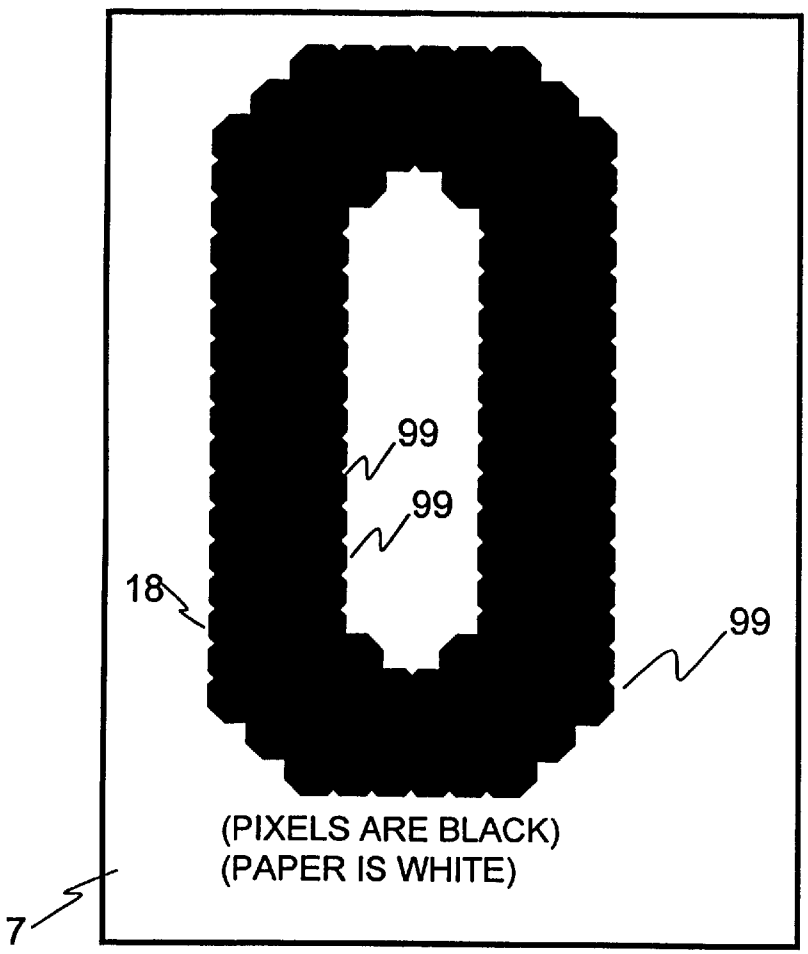
FIG. 2A is a drawing in greater detail of a numeric character of region 7 of indicia 11 of FIG. 1

FIG. 2A is a drawing in greater detail of a numeric character of region 7 of indicia 11 of FIG. 1. One of the zeros of the dollar amount of postage 18 (FIG. 1) is depicted as a plurality of printed pixels 99.

FIG. 2B is a drawing showing the manner in which the print head pulses that printed the numeric character of FIG. 2A are stored in a portion of non-volatile memory 9. A portion of memory 9 has 252 locations 8. A print head firing or print head pulse 6 is recorded in non-volatile memory 9 as a pixel (black cell); and, when there is no print head firing, no pixel would be recorded in memory 9 (white cell).

Figure 2C:
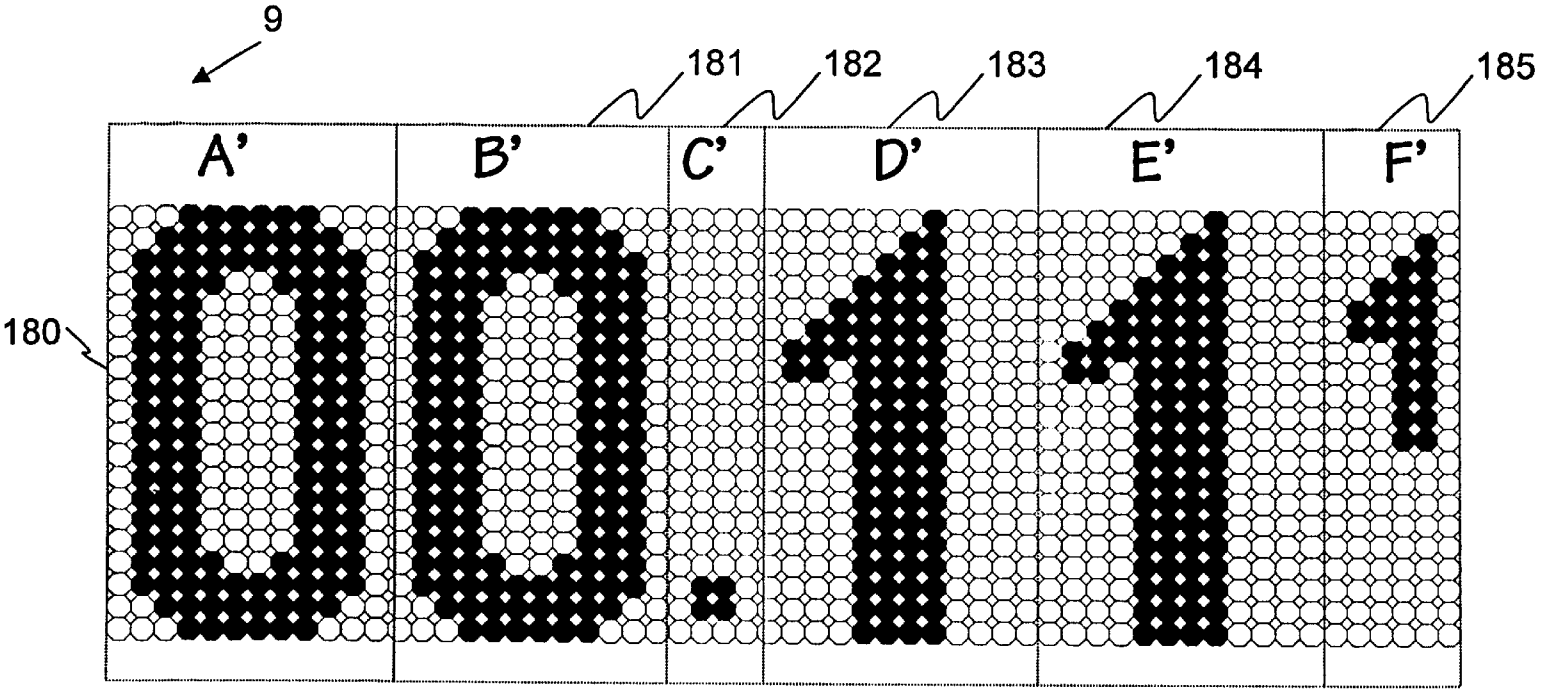
FIG. 2C is a drawing showing the segmentation of the dollar amount of postage 18 and its storage in non-volatile memory 9.

FIG. 2C is a drawing showing the segmentation of the dollar amount of postage 18 and its storage in non-volatile memory 9. The dollar amount of postage 18, i.e., $00.111 is segmented in non-volatile memory 9. The numeric character that represents the tens of dollars of postage 18 is segmented and stored in matrix of cells 180, and the numeric character that represents the dollars of postage 18 is segmented and stored in matrix of cells 180. The decimal point of postage 18 is segmented and stored in matrix of cells 182. The numeric character that represents the tens of cents of postage 18 is segmented and stored in matrix of cells 183, and the numeric character that represents the tenths of cents of postage 18 is segmented and stored in matrix of cells 184. The tenths of cents of postage 18 is segmented and stored in matrix of cells 185.

Figure 3B:
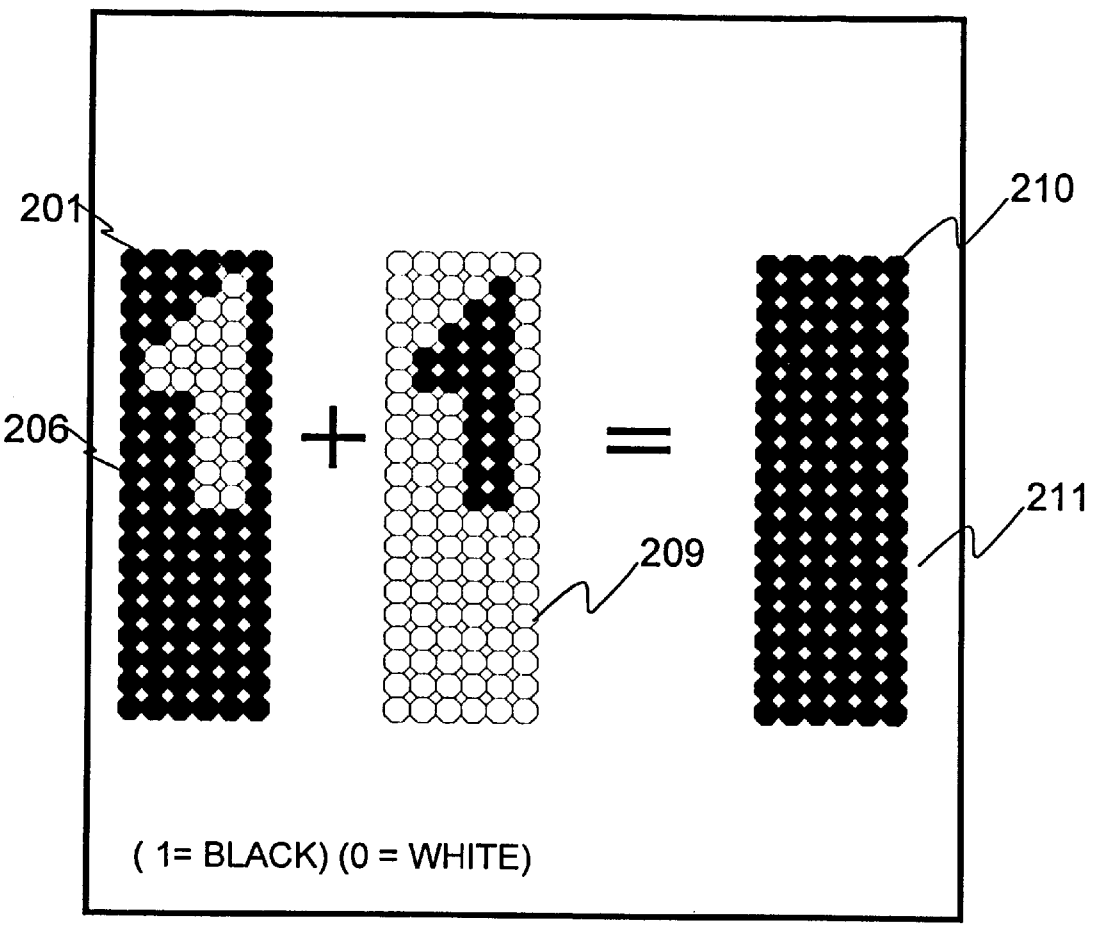
FIG. 3B is a drawing of a graphic rendition of the template 201 summing process that recognizes superscript numeric 1 (one) as the printed character.
Figure 3A:
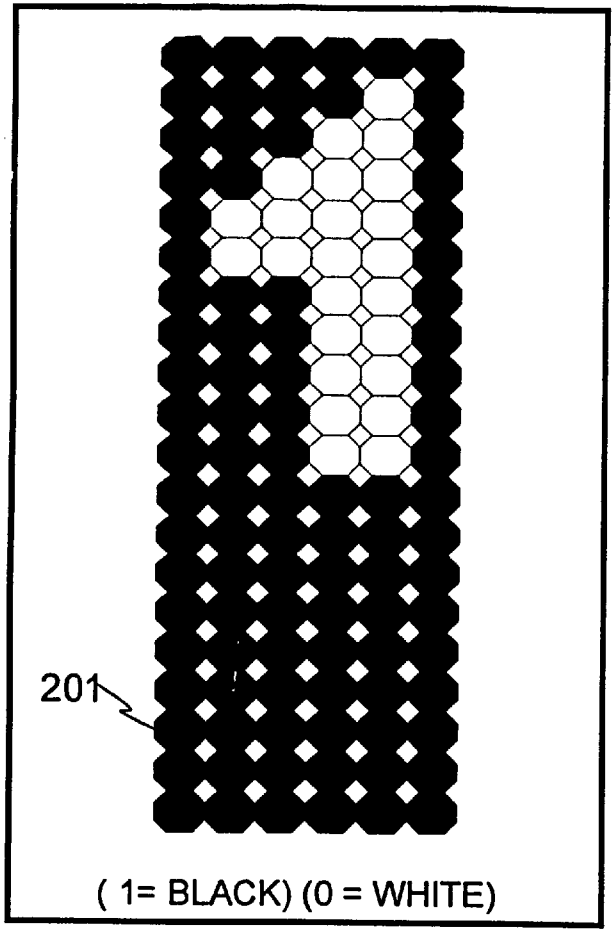
FIG. 3A is a drawing of a template 205 showing the numeric 1 (one) superscript.

FIG. 3A is a drawing of a template 205 showing the numeric 1 (one) superscript. Template 205 has 120 locations 206. A dot or pixel of the numeric one superscript is recorded as empty space 207 (white cell); and, where no dot or pixel exists for the numeric one superscript, a dot or pixel of this space is indicated in locations 208 (black cell).

FIG. 3B is a drawing of a graphic rendition of the template summing process that recognizes superscript numeric 1 (one) as the printed character. The graphic rendition of the superscript numeric 1 (one) is shown in the template 201. The mirror image of the superscript numeric 1 (one) is stored in non-volatile memory 9. Non-volatile memory 9 has 120 locations 209, and template 201 has 120 locations 206. A print head firing or print head pulse is recorded in template 201 as a pixel (white cell), and when there is no print head firing, template 201 records this fact as a white cell. A print head firing or print head pulse is recorded in non-volatile memory 9 as a pixel (black cell), and when there is no print head firing, no pixel would be recorded in memory 9 (white cell).

Template 210 has 120 locations 211. If the sum of the cells in template 201 is added to the sum of the locations in template 209 and all of the locations 211 in template 210 are black cells, a match exists. Thus, the superscript numeric 1 (one) in template 201 is the same as the superscript numeric 1 (one) in non-volatile memory 9.

Figure 3C:
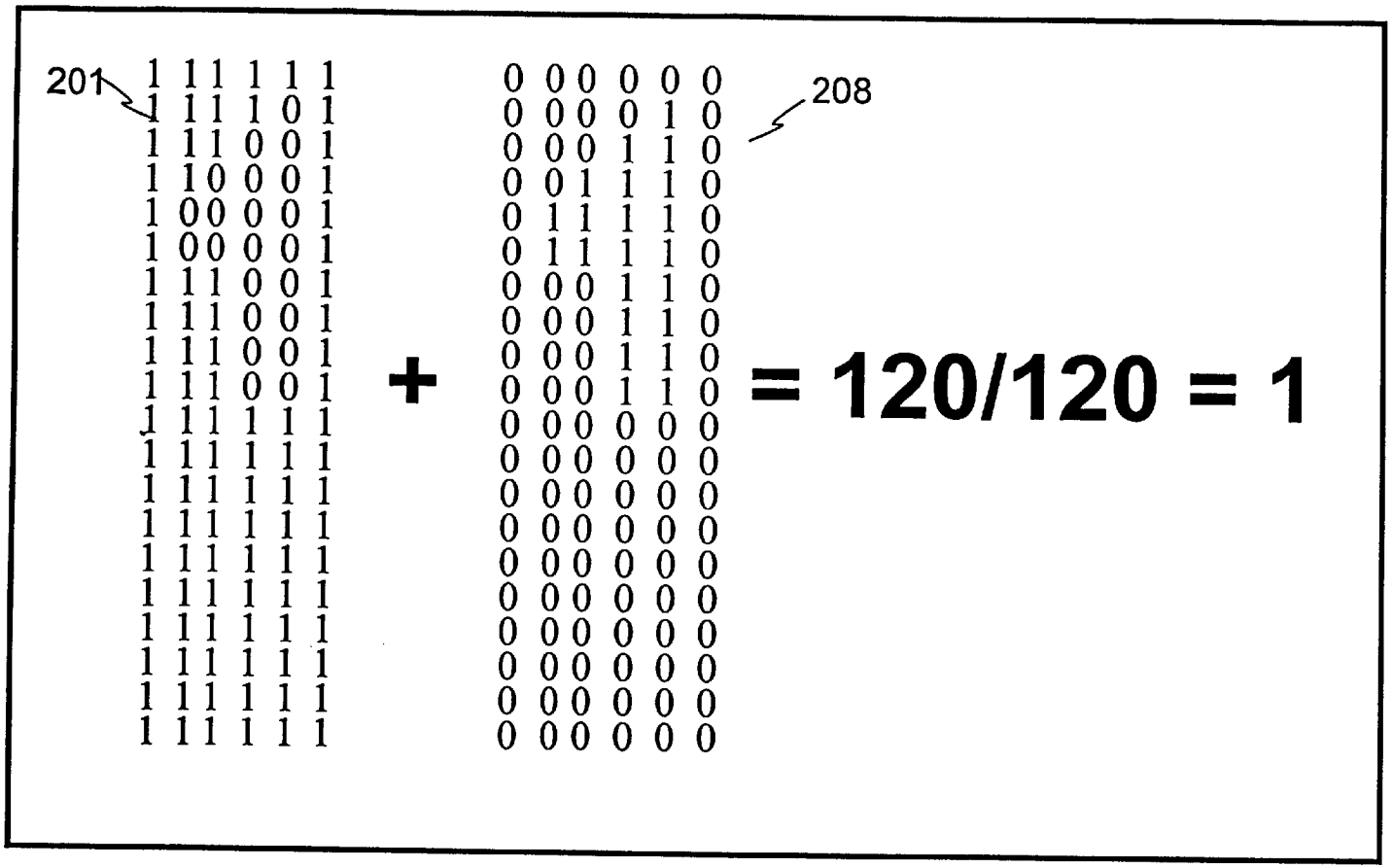
FIG. 3C is a drawing of a numeric rendition of the summing of template 201 and template 208.

FIG. 3C is a drawing of a numeric rendition of the summing of template 201 and template 208. The black cells of FIG. 3B are shown in FIG. 3C as "1" and the white cells of FIG. 3B are shown in FIG. 3C as "0". If the sum of the cells in templates 201 and 208 equals 120 a match exists, since 120/120=1. Thus, the above summing process recognized the superscript numeric 1 (one) as the printed character.

Figure 4:
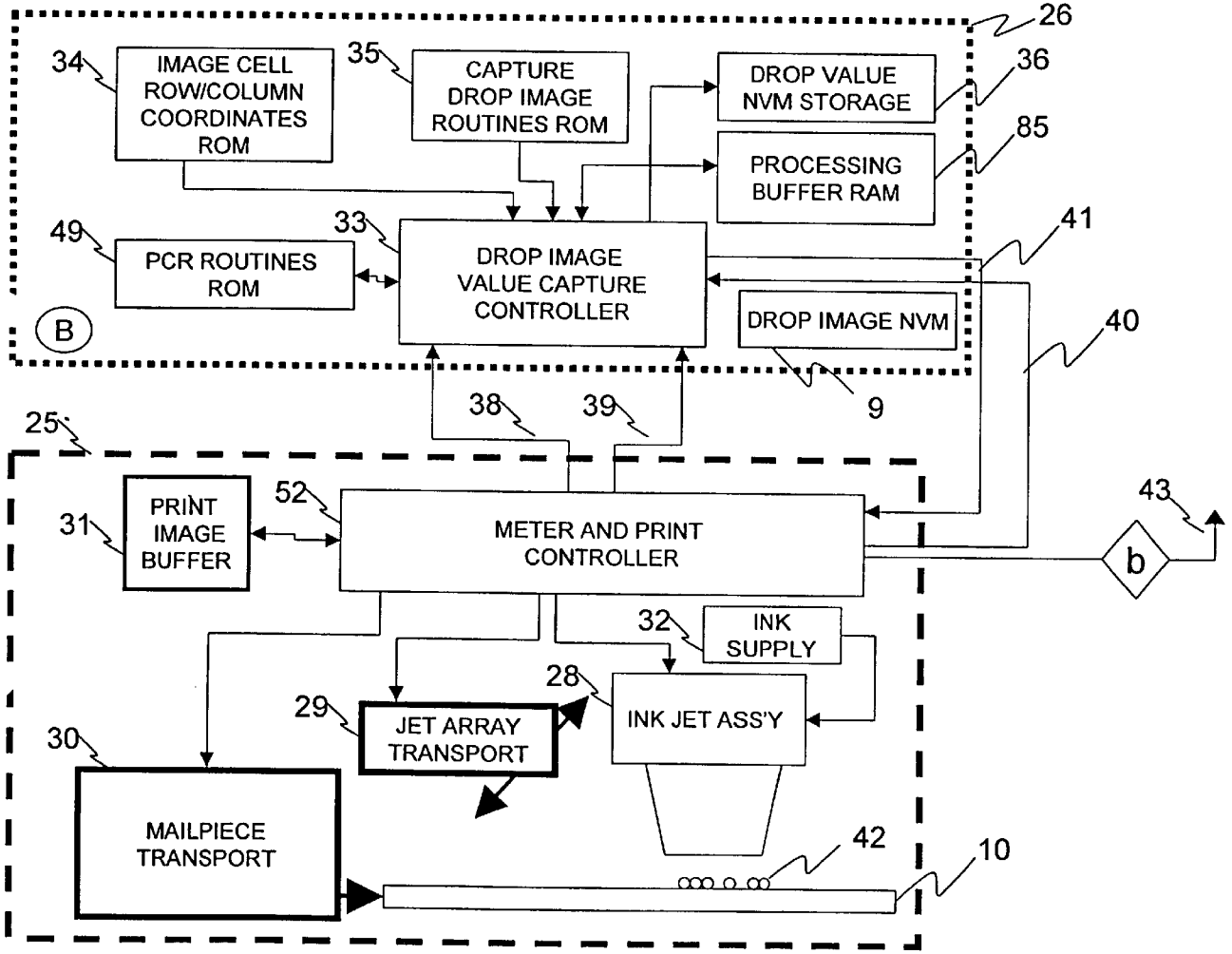
FIG. 4 is a block drawing showing meter controller 52 connected to printer 25 and information capture module 26.

FIG. 4 is a block drawing of meter and printer controller 52 functioning as a printer controller. FIG. 3 shows a print module 25 and an information capture module 26. Print module 25 comprises: a meter and print controller 52; an ink jet assembly 28; an ink jet array transport 29; a mail piece transport 30; a print image buffer 31; and an ink supply 32 that is coupled to ink jet assembly 28. Print controller 52 is coupled to ink jet assembly 28, ink jet array transport 29, mail piece transport 30, print image buffer 31, and ink jet assembly 28. Information capture module 26 comprises: droplet image value capture controller 33; image cell row/column coordinates Read Only Memory 34; capture drop image routines Read Only Memory 35; Printer Character Routines Read Only Memory 200; processing buffer Random Access Memory 85 drop image non-volatile memory 9, and drop value storage non-volatile memory 36. Processor 33 is coupled to ROM 34, drop image non-volatile memory 9; capture drop image routines ROM 35, drop value non-volatile storage memory 36, ROM 200; processing buffer Random Access Memory 85 and meter and print controller 52. It would be obvious to one skilled in the art that either a laser printer with an information capture module 26 (FIG. 4) or other digital printers may be used instead of ink jet assembly 28 and ink supply 32 to apply postage to an envelope, label or post card.

Figure 5:
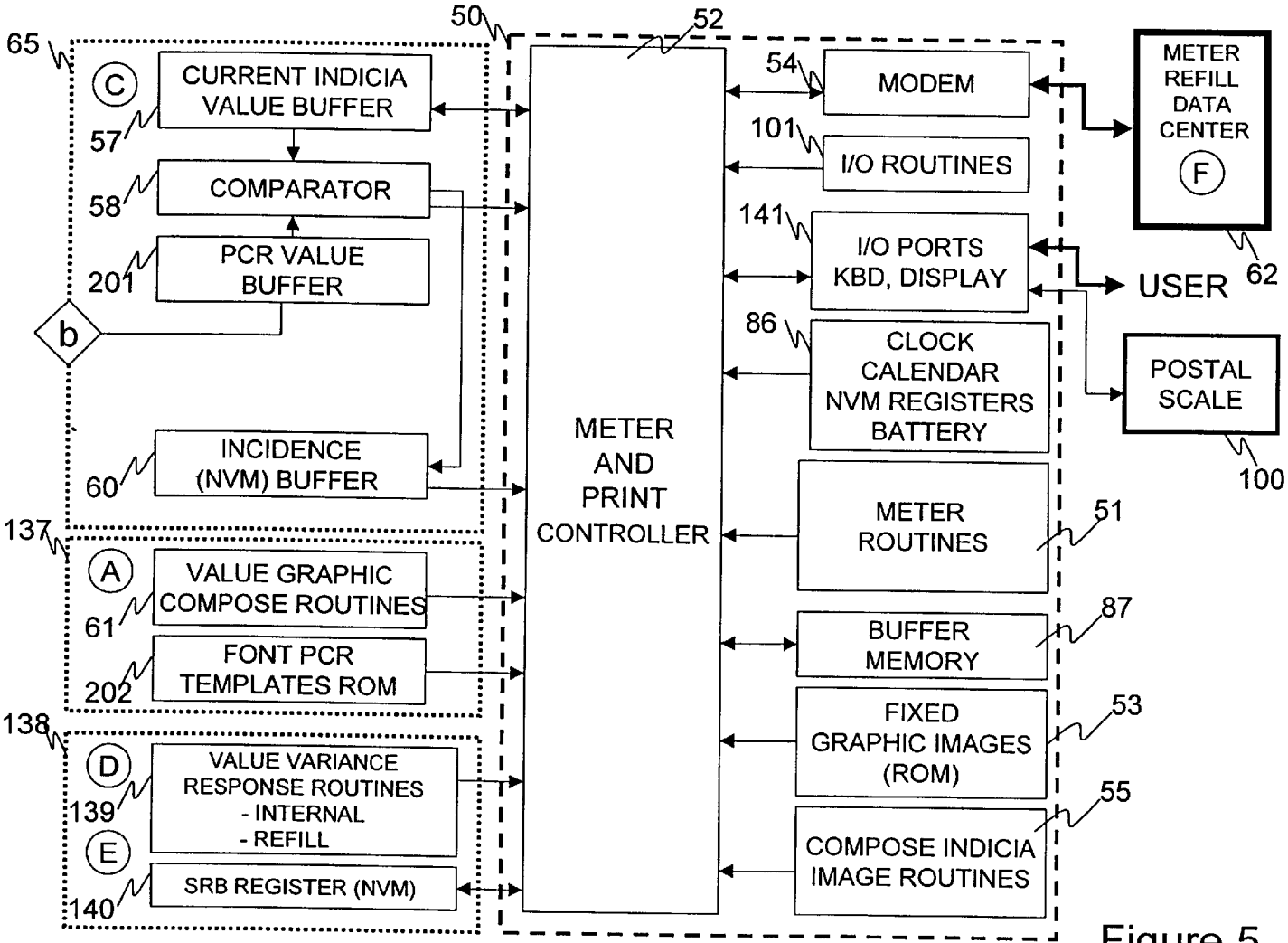
FIG. 5 is a block diagram showing meter and printer controller 52 functioning as a meter controller.

When one wants to print indicia 11 on mail piece 10 (FIG. 1), one places mail piece 10 in the mail piece transport 30 and sets the correct postage value in electronic meter 50 (FIG. 5), i.e. $0.111. Print image input data will then be transferred from print image buffer 31 to meter and print controller 52. The print image input data will include all of the information that is necessary to print indicia 11. The above information will include the information that is required to print region 7 of indicia 11. Controller 52 will cause mail piece transport 30 to move mail piece 10 under ink jet assembly 28 back and forth and ink jet array transport 29 to move ink jet assembly 28 to deposit ink drops 42 on mail piece 10 to form indicia 11. As the printing process proceeds, controller 52 also provides position data via line 38 and droplet data via line 39 to controller 33. Controller 52 will transmit the position data for region 17 of indicia 11 to droplet image value capture processor 33 via line 38. Controller 52 will transmit the droplet data for region 17 of indicia 11 to droplet image value capture processor 33 via line 39 and controller 52 will provide a data clock signal to processor 33 via line 40. At the appropriate time, controller 33 will obtain the row and column coordinates of region 17 from ROM 34. The routines in ROM 35 are used to capture the number of drops in region 17 (FIG. 2) and to temporarily store each drop enabling pulse synchronously in non-volatile memory 36. Controller 33 utilizes the computational routines in ROM 200 to convert the bit map image stored in memory 9 with the font templates stored in ROM 289 (FIG. 5). Thus, memory 36 will store the dollar amount of postage 18 indicated in indicia 11 (FIG. 1). Controller 33 will transmit the amount of postage 18 to controller 52 via line 41, and the controller 52 transfers the postage 18 via line 43 to buffer 288 (FIG. 5).

FIG. 5 is a block diagram showing meter and printer controller 52 functioning as a meter controller. Electronic meter 50 includes meter routines 51, meter and print controller 52, fixed graphic image Read Only Memory 53, modem 54, compose indicia image routines 55, clock calendar non-volatile memory and battery 86, I/O routines 101, I/O ports, keyboard and display 141 and buffer memory 87. Controller 52 is coupled to modem 54, I/O routines 101, and meter routines 51, I/O port keyboard display 141. A postage verifying module 65 is coupled to electronic meter 50. Module 65 includes: a current indicia value buffer 57 that is coupled to controller 52; a comparator 58 that is coupled to buffer 57 and controller 52, printer character recognition buffer 201 that is coupled to comparator 58; an incident, non-volatile memory buffer 60 that is coupled to comparator 58 and to controller 52; encoding module 137 includes graphic encoding routines 61 and font printer character recognition templates 202. Value graphic compose encoding routines 61 are coupled to controller 52, and ROM 202 is coupled to controller 52. Modem 54 is coupled to meter refill data center 62. Postal scale 100 is coupled to I/O ports keyboard and display 141.

Meter 50 begins to function when a user sets the postage dollar amount 18 (FIG. 1) by weighing mail piece 10 on scale 100. Alternatively, the user may enter the weight of mail piece 10 into I/O ports, keyboard and display 141 of meter 50. The weight and amount of postage for mail piece 10 is displayed by meter 50. Controller 52 will compose an image of indicia 11 (FIG. 1) using the fixed graphic images from ROM 53 and using encoding routines 61. The above image will be stored in print image buffer 31. Buffer 31 will provide the above image to meter controller 52. Upon completion of region 17 of indicia 11, the drop values stored in non violate memory 36 may be transferred by controller 33 via line 41 to controller 52. Controller 52 will also transfer the above values via line 43 printer character recognition to buffer 201. Process controller 52 causes controller 33 to utilize the PCR routines stored in ROM 200 to convert the drop image in non-volatile memory 9 into its numeric value which is stored in memory 36. Controller 52 stores the value produced by converter 59 in buffer 201. The value stored in buffer 201 is compared by comparator 58 to the value stored in buffer 57. A match causes no output. A mismatch causes the difference between the value in buffer 201 and buffer 57 to be stored in buffer 60. When buffers 57 and 201 do not have the same value, there exists the possibility of fraud or a micro processor malfunction. Meter routines 51 will handle the accounting functions of meter 50. Routines 51 are not being described because one skilled in the art is aware of their operation and function.

Modem 54 communicates with meter data center 62 during a refill of postage meter 50 by exchanging funds, and the difference in value between buffers 57 and 88 is stored in buffer 60 so that possible fraud may be investigated.

Figure 6:
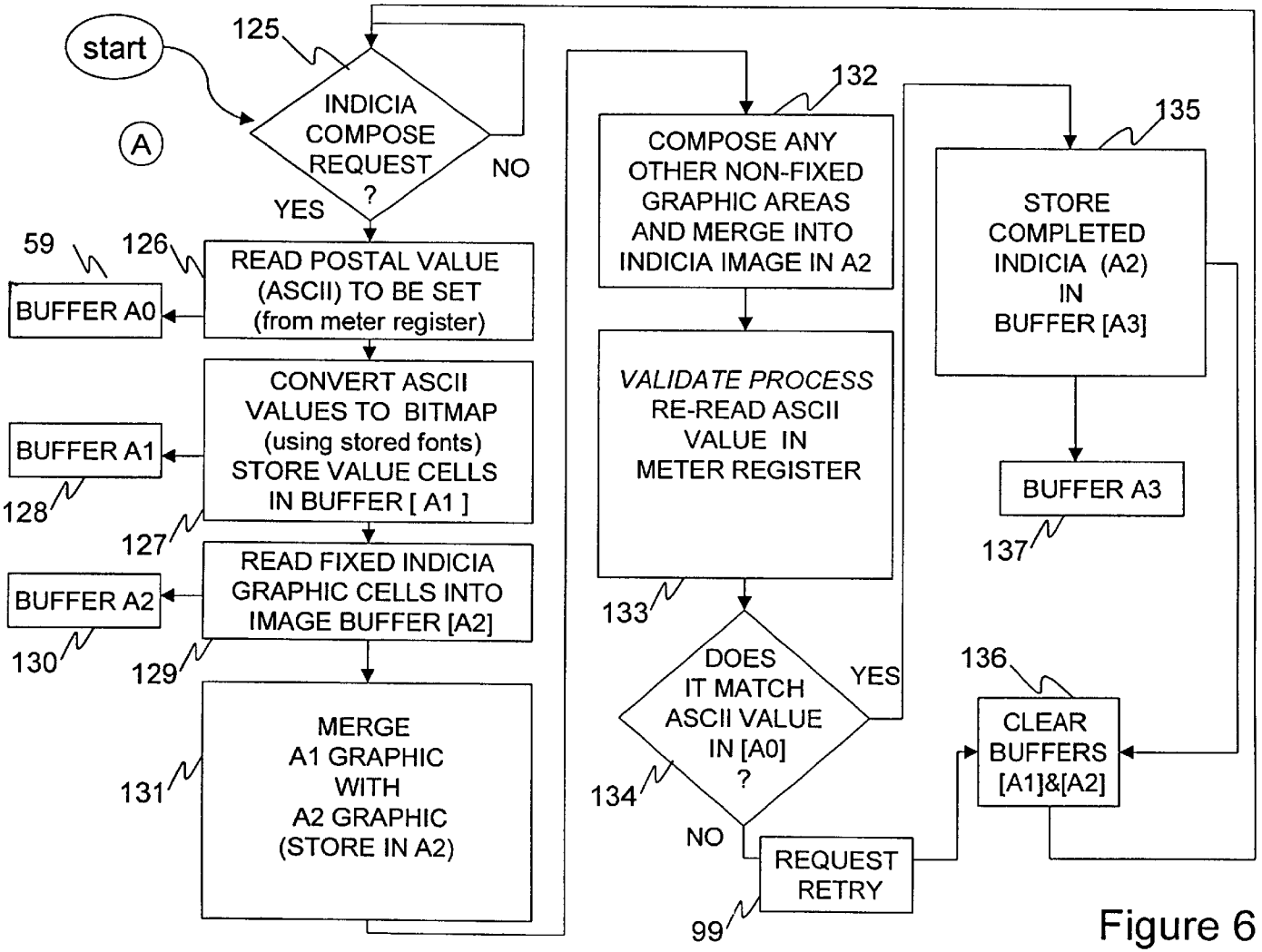
FIG. 6 is a flow chart showing how region 7 and region 12 are formed.

FIG. 6 is a flow chart showing how regions 7 and 12 are formed. The program begins in decision block 125. Block 125 determines whether or not a compose request has been received from meter controller 52. If block 125 determines that a compose request has not been received, the program goes back to the input of block 125. If block 125 determines that a compose request has been received, the program goes to the input of block 126. Block 126 reads the amount of postage (ASCII) that was set in meter 50 by the user, i.e., $0.111. Now the program goes to block 59 to store the value obtained in block 126 in the buffer of block 59. Then the program goes to block 127 to convert the ASCII values to bit map values using the stored templates of region 7. The bit map values are now stored in the buffer of block 128. At this point the program goes to block 129 to read the fixed indicia graphics. The fixed graphics are then stored in the buffer in block 130.

At this point, the program goes to block 131 to merge the graphic stored in the buffer of block 128 with the graphic stored in the buffer of block 130. Now the program goes to block 132 to compose any other non-fixed graphic areas and merge them into the indicia image stored in the buffer of block 130. Then the program goes to block 133 to begin the validation process. The validation process will re-read the ASCII in the meter register. Now the program goes to decision block 134. Block 134 determines whether or not the ASCII value in the meter register matches the ASCII stored in the buffer of block 59. If block 134 determines that the ASCII values do not match, the program knows that a mistake was made, and the program goes to block 99 to request a retry and to block 136. Block 136 will clear the buffers in blocks 128 and 130. Then the program will go back to the input of block 125. If block 134 determines that the ASCII values match, the program knows that a mistake was not made, and the program goes to the input of block 135. Block 135 stores the completed indicia from the buffer in block 130. The foregoing result is stored in the buffer of block 137. The program also goes to block 136 to clear the buffers in blocks 128 and 130. Then the program will go back to the input of block 125.

Figure 7A:
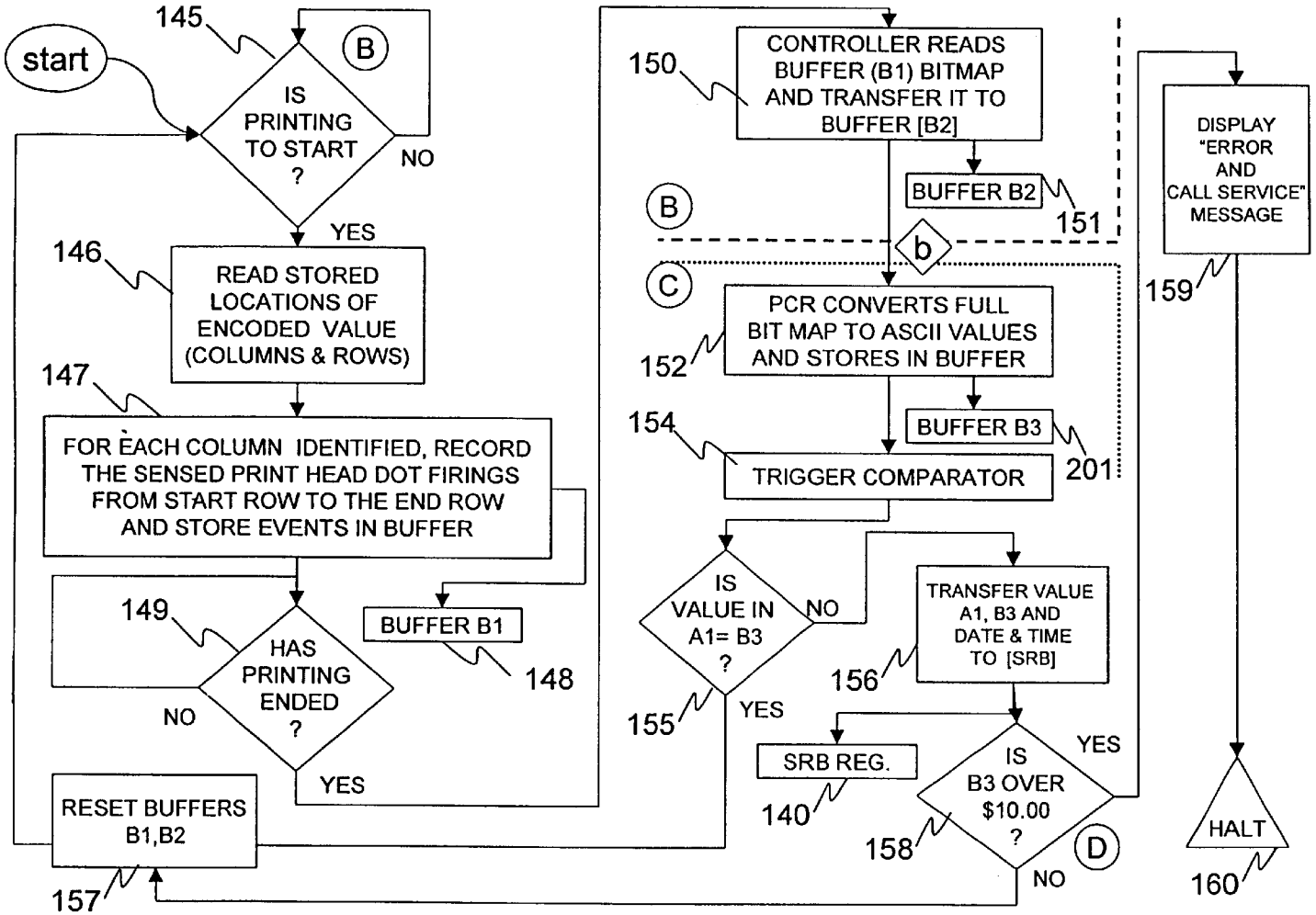
FIG. 7A is a flow chart of the program contained in meter routines 51; and also a portion of the program contained in controller 52.

FIG. 7A is a flow chart of the program contained in meter routines 51 and a portion of the program contained in controller 52. The input to block 145 is received from controller 52. Decision block 145 determines whether or not the printing that is going to take place (FIG. 5) has begun. If block 145 determines that the printing has not begun, the program goes back to the input of block 145. If block 145 determines that the printing has begun, the program goes to the input of block 146. Block 146 reads the stored locations of non-volatile memory 9 the encoded value by column and row. Then the program goes to block 147. For each of the columns identified in matrix of cells 180–185, block 147 records the sensed print head pixel or drop firings and stores them in the buffer in block 148. Now the program goes to decision block 149. Block 149 determines whether or not the printing has ended. If block 149 determines that the printing has not ended, the program goes back to the input of block 149. If block 149 determines that the printing has ended the program goes to the input of block 150. In block 150 controller 33 (FIG. 3) reads the bit map values stored in the buffer in block 148 and transfers the values to the buffer in block 151. Then the program goes to block 152 where the printer character routines converts the bit map to ASCII values. The ASCII values is stored in the buffer in block 201.

At this point the program goes to block 154. Block 154 triggers comparator 58 (FIG. 4). Then the program goes to decision block 155. Block 155 determines whether or not the value in the buffer in block 128 equals the value in the buffer in block 201. In other words, does the postage set by the user of meter 50 equal the value of the postage indicated in region 7, i.e.: the value in buffer 57, equal the value in buffer 88 which equals the value in non-volatile memory 9. If block 155 determines that the value of the buffer in block 128 equals the value of the buffer in block 201, the program goes to block 157 to reset the buffers in blocks 148 and 151. Then the program goes back to the input of block 145. If block 155 determines that the value of the buffer in block 128 does not equal the value of the buffer in block 201, the program goes to block 156.

Block 156 will transfer the value of the buffer in block 128 and the value of the buffer in block 201 and the date and time to the Special Refill buffer in block 161.

Now the program will go to decision block 157. Block 157 will determine whether or not the value stored in the buffer of block 201 is greater than $10.00. If block 158 determines that the amount is less than $10.00, the program will go to block 158 to reset buffers 148 and 151. Then the program will go back to the input of block 145. If block 157 determines that the amount is over $10.00, the program goes to block 159 to display the error to display a call service message. Then the program goes to block 160 and halts.

Figure 7B:
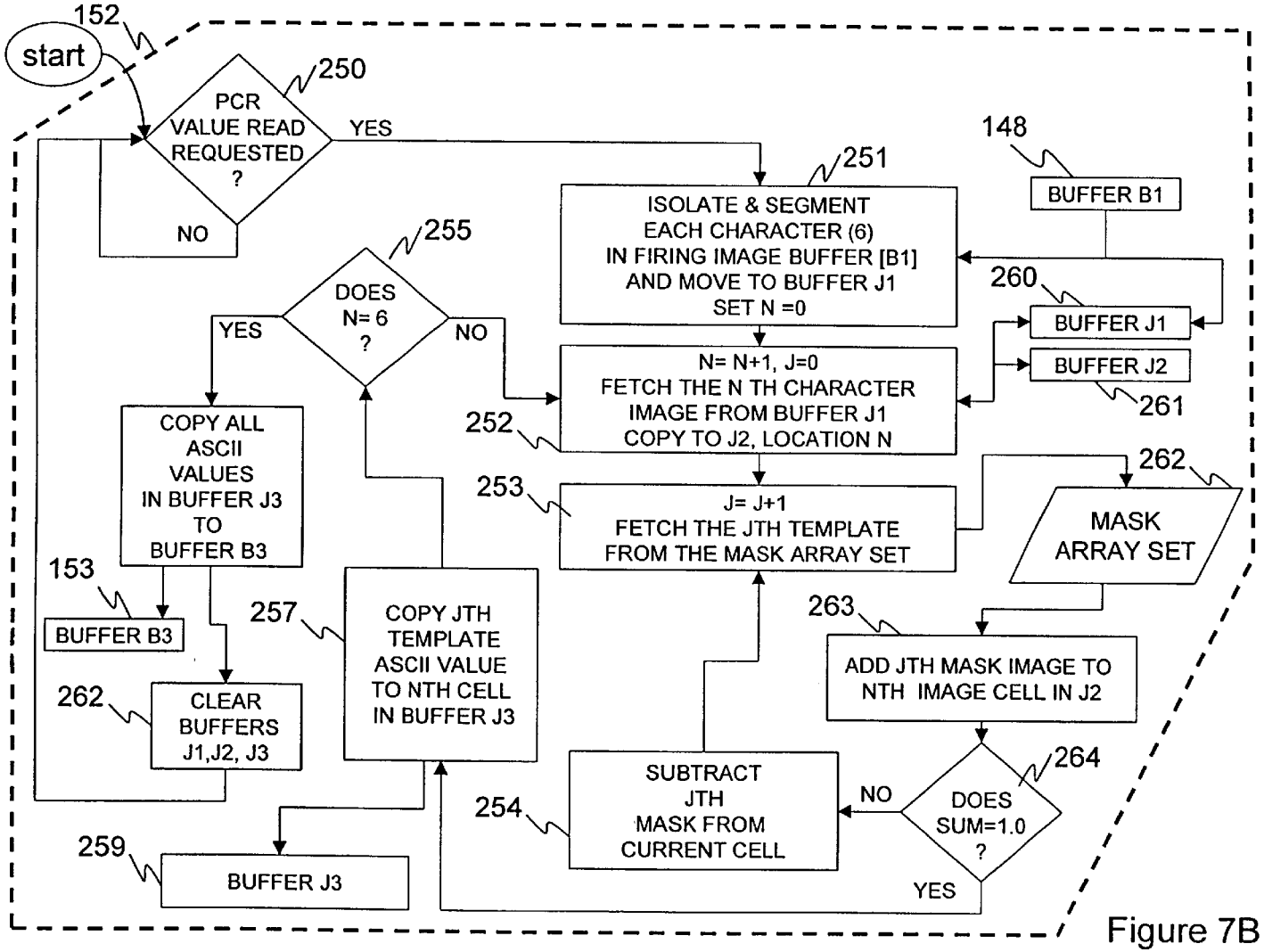
FIG. 7B is a flow chart of the program contained in controller 33 and routines 35.

FIG. 7B is a flow chart of the program contained in controller 33 and routines 35.

The program begins in block 250. Decision block 250 determines whether or not the printer character routines value has been requested to be read. If block 250 determines that the printer character routines value has not been read, the program goes back to the input of block 250. If block 250 determines that the printer character routines value has been read, the program goes to the input of block 251. Block 251 isolates and segments each character in cells 180, 181, 182, 183, 184 and 185 of non-volatile memory 9 (FIG. 2C) in the firing image buffer contained in block 148. Then the information in buffer 148 is transferred to buffer J1 block 260. Block 251 will also set N=0. Now the program will go to block 252. Block 252 sets N=N+1 and J=0, where N equals the number of the character in non-volatile memory 9 and J equals one of the templates to test the pixel pattern in non-volatile memory 9. There are 21 templates, i.e.: standard size font 0–9 and superscripted font 0–9 and a decimal point. It will be obvious to one skilled in the art that the number of characters may increase or decrease at the whim of the post. Block 252 will fetch the Nth character from the buffer located in block 260 and copy the Nth character to the buffer located in block 261. Now the program will go to block 253. Block 253 will set J=J=1 and fetch the Jth template from the mask array set. Then the program will go to block 262 to mask the array set.

Then the program goes to block 263 to add the Jth mask image to the Nth image cell in the buffer in block 261. Now the program goes to block 264. Decision block 264 determines whether or not the sum equals 1.0. If block 264 determines that the sum does not equals 1.0, the program goes to block 253. Then the program goes back to block 253 to set J=J=1. If block 264 determines that the sum equals 1.0, the program goes to the input of block 257.

Block 257 copies the Jth template ASCII value to the Nth cell in the buffer in block 259. Now the program goes to decision block 255. Block 255 determines whether or not N=6. If block 255 determines that N does not equal 6, the program goes back to block 252. If block 255 determines that N equals 6, the program goes to block 256. Block 256 copies all ASCII values in the buffer in block 259 to the buffer in block 153. Now the program goes to block 258 to clear the buffers in blocks 260, 261 and 259. At this point the program goes back to the input of block 250.

Figure 8A:
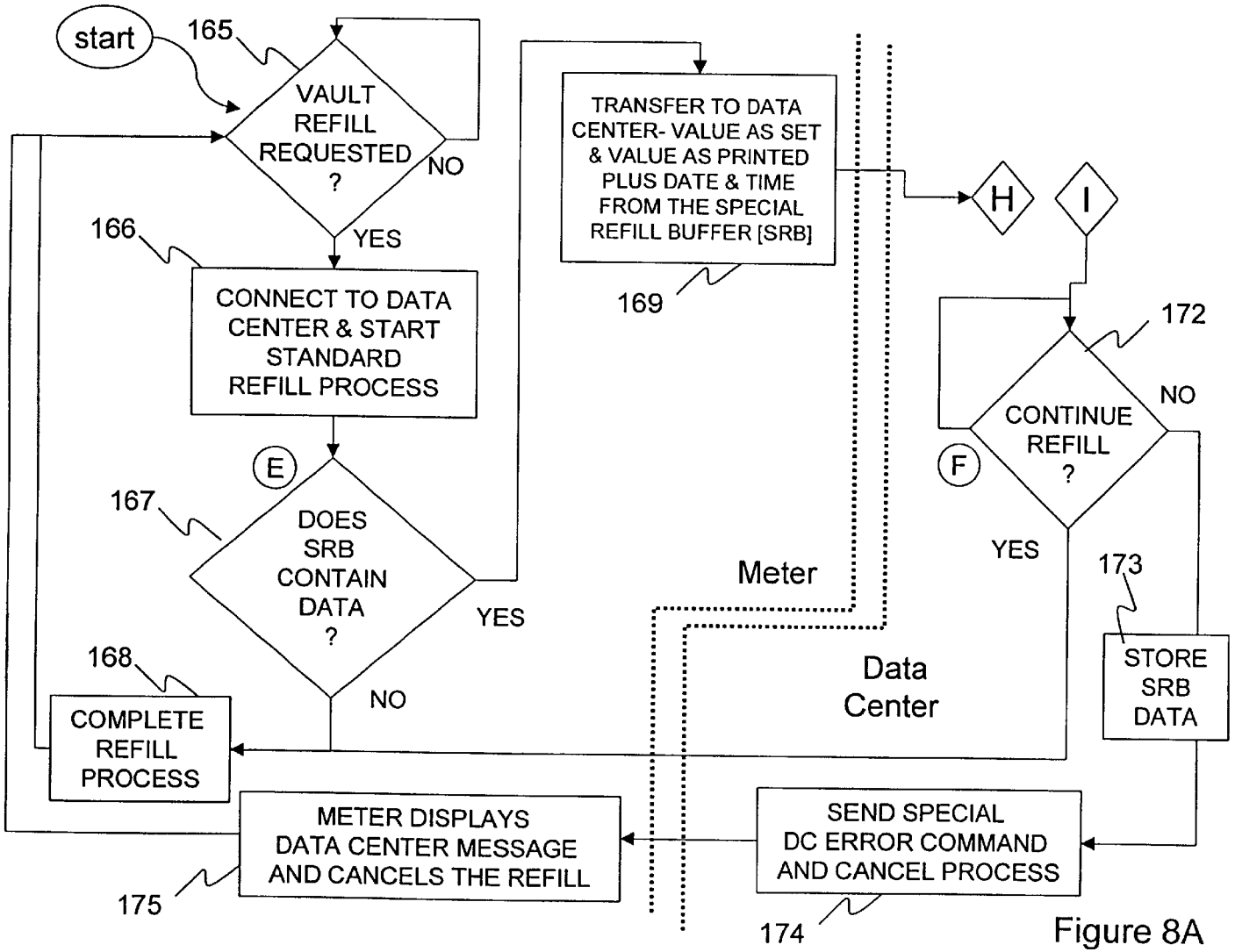
FIGS. 8A and 8B is a flow chart of a portion of the program contained in controller 52 and of the program contained in data center 62.
Figure 8B:
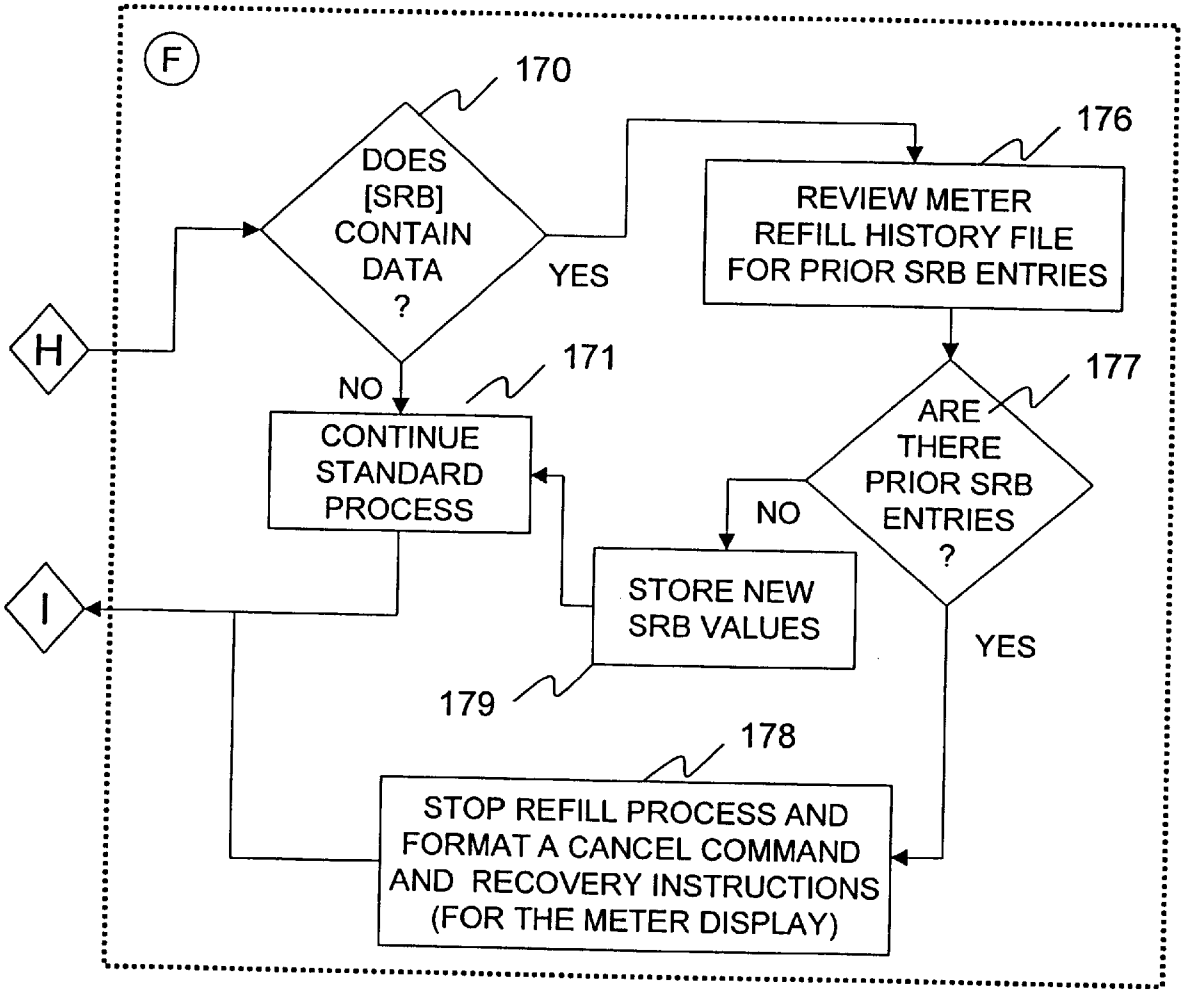

FIGS. 8A and 8B is a flow chart of a portion of the program contained in controller 52 and of the program contained in data center 62. The input to block 165 comes from meter controller 52. Decision block 165 determines whether or not the user of meter 50 has requested that additional funds be added to the vault (not shown) of meter 50. If block 165 determines that no additional funds have been requested by the user of meter 50, the program goes back to the input of block 165. If block 165 determines that the user of meter 50 has requested that additional funds be added to the vault, the program goes to block 166. Block 166 connects meter 50 to data center 62 and starts the standard meter refill process (which is well-known in the art).

At this point, the program goes to decision block 167. Block 167 determines whether or not the special refill buffer in block 161 contains any data. If block 167 determines that the buffer in block 161 does not contain any data, the program goes to block 168 to complete the meter refill process. Then the program goes back to the input of block 165. If block 167 determines that the buffer in block 161 contains data, the program goes to block 169 to transfer to data center 62 the postage value as set by the user and the postage value as printed on mail piece 10, i.e.: $0.111 plus the date and time from the special refill buffer in block 161.

Then the program goes to the input of decision block 170 (FIG. 8B). Block 170 determines whether or not the special refill buffer in block 161 contains data. If block 170 determines that the buffer (not shown) in data center 62 does not contain data, the program goes to block 171 to continue the standard meter refill process. Now the program goes to the input of decision block 172 (FIG. 8A). Block 172 determines whether or not to continue the standard meter refill process. If block 172 determines to continue the refill process, the program goes to block 168 to continue the refill process. Then the program goes back to the input of block 165.

If decision block 170 (FIG. 8B) determines that the special refill buffer in block 161 contains data, the program goes to block 176 to review the meter refill history file for prior special refill buffer entries. Then the program goes to decision block 177. Block 177 determines whether or not there are any prior special refill buffer entries in block 161. If block 177 determines that there were prior entries in block 161, the program goes to block 178 to stop the meter refill process and format a cancel command and recovery instructions for the display of meter 50 (FIG. 5). Then the program goes back to the input of decision block 172 (FIG. 8A).

If block 172 determines not to continue the meter refill process, the program goes to block 173 to store the special refill buffer data in the buffer in data center 62 (not shown). At this point, the program goes to block 174 to send a special data center 62 (FIG. 4) error command and cancel the meter refill process. Then the program goes to block 175 to display the data center 62 error message on the display of meter 50 notifying the user of the cancellation of the refill process.

If block 177 determines that there are no prior special refill buffer entries in block 161, the program will go to block 179 to store the new special refill buffer entries. Then the program will go to block 171.

Figure 9:
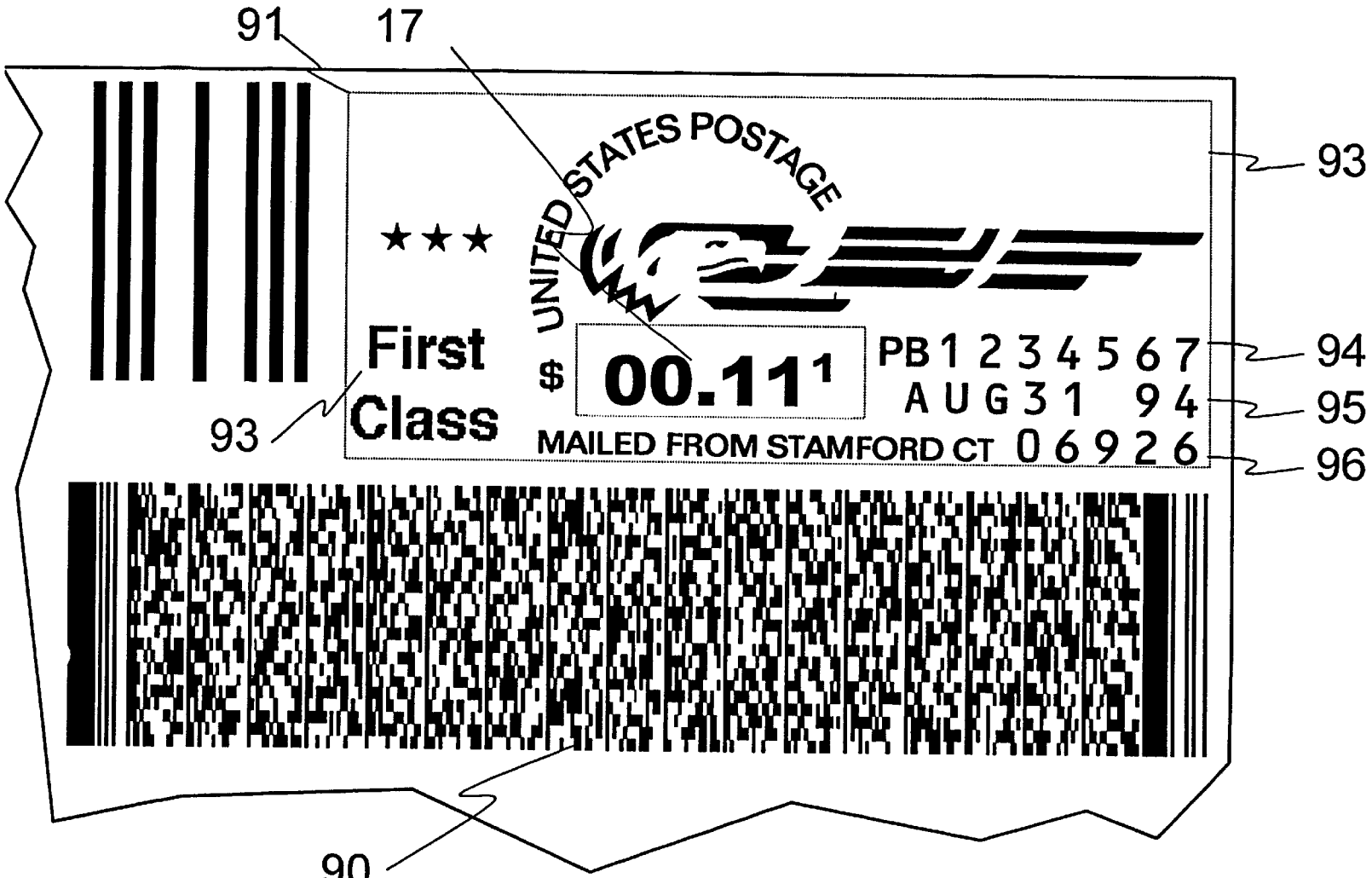
FIG. 9 is a drawing of an Information Based Indicia affixed to a mail piece.

FIG. 9 is a drawing of an Information Based Indicia affixed to mail piece 10. Indicia 91 has a graphic region 92, a fixed and variable text region 93, and a two dimensional bar code 90. Region 92 includes a region 7 that is printed with 240 pixels which form the postal value that is interpreted by this invention. Region 93 contains a postal meter serial number 94, the date 95, the place the mail piece was mailed from 96, and a dollar amount 98.

Indicia 91 may be produced by a personal computer, a printer combined with either a postal security device attached to the personal computer (personal computer postage meter), or a postal security device coupled to a personal computer via a data center and a printer (virtual postage meter).

The above specification describes a new and improved apparatus for providing security to documents by determining what is printed on a mail piece by reading the printer firings and comparing them to the value stored in non-volatile memory. It is realized that the above description may indicate to those skilled in the art additional ways in which the principals of this invention may be used without departing from the spirit. It is, therefore, intended that this invention be limited only by the scope of the appended claims.

What is claimed is:

1. A metering system having a printing mechanism for printing value, the improvement comprising: within the metering system, a recorder to store the numbers of print signal pulse firings that are used to produce value, and means for interpreting the print signal pulses to verify that the value printed is equal to the value decremented by the meter.

2. The metering system claimed in claim 1, wherein the metering system is a postage metering system that produces a postal indicia.

3. The meter claimed in claim 2, wherein the signal pulse firings are stored in a two dimensional non-volatile memory.

4. The meter claimed in claim 3, wherein the value decremented by the meter is stored in a register.

5. The meter claimed in claim 3, wherein the meter includes a comparator that compares an ASCII value of the amount of postage paid with a stored ASCII of the interpreted print signal pulse firings.

6. The meter claimed in claim 5, further including:

a memory that stores the cumulative differences in postage indicated by the comparator.

7. The meter claimed in claim 6, further including:

a locking mechanism that prevents the meter from printing additional indicia when the cumulative differences in postage reach a specified value.

8. The meter claimed in claim 6, wherein the meter uploads the differences in postage stored in the memory to a data center during a meter refill.

9. The meter claimed in claim 8, wherein the data center includes means for notifying the postal authorities when the cumulative differences in postage reach a specified value.

10. The meter claimed in claim 2, wherein possible fraud is indicated if the postage stored in a text region in the postal indicia is not the same as the postage indicated by the signal pulse firings.

11. The meter claimed in claim 1, wherein the meter is an electronic postage meter.

12. The meter claimed in claim 1, wherein the meter is a personal computer and a postal security device.

13. The meter claimed in claim 1, wherein the meter is a virtual meter.

14. A meter having a printer that includes a digital print head that prints a postal indicia, the print head comprises:

a first module coupled to the digital print head, wherein the first module captures specified driver pulses from the print head that are used to print pixels that comprise the postal indicia;

a first module coupled to the digital print head, wherein the first module captures specified driver pulses from the print head that are used to print pixels that comprise the postal indicia;

a second module coupled to the first module for interpreting the specified driver pulses associated with regions of the indicia;

means coupled to the first and second modules for linking an ASCII value of the interpreted patterns of driver pulses to an ASCII value of the amount of postage indicated in the postal indicia; and a comparator for comparing the ASCII value of the amount of postage indicated in the postal indicia with the ASCII value of the postal value set in the meter by an operator of the meter.

* * * * *